US007424877B2

(12) United States Patent
Wagner

(10) Patent No.: US 7,424,877 B2
(45) Date of Patent: Sep. 16, 2008

(54) INTERNAL COMBUSTION ENGINE

(75) Inventor: Johann Wagner, Graz (AT)

(73) Assignee: AVL List GmbH, Graz (AT)

( * ) Notice: Subject to any disclaimer, the term of this patent is extended or adjusted under 35 U.S.C. 154(b) by 337 days.

(21) Appl. No.: 10/561,036

(22) PCT Filed: Jun. 24, 2004

(86) PCT No.: PCT/AT2004/000218

§ 371 (c)(1),
(2), (4) Date: Jan. 13, 2006

(87) PCT Pub. No.: WO2004/113688

PCT Pub. Date: Dec. 29, 2004

(65) Prior Publication Data

US 2006/0169235 A1 Aug. 3, 2006

(30) Foreign Application Priority Data

Jun. 24, 2003 (AT) ..... GM 433/2003

(51) Int. Cl.
*F01L 1/04* (2006.01)

(52) U.S. Cl. ..... 123/90.6; 123/90.16; 123/90.31; 29/888.1

(58) Field of Classification Search ..... 123/90.16, 123/90.2, 90.39, 90.44, 90.6, 90.27, 90.31; 29/888.1

See application file for complete search history.

(56) References Cited

U.S. PATENT DOCUMENTS

| | | | | |
|---|---|---|---|---|
| 4,424,790 | A * | 1/1984 | Curtil | 123/559.1 |
| 4,805,571 | A * | 2/1989 | Humphrey | 123/316 |
| 4,886,022 | A | 12/1989 | Nakai | |
| 5,136,887 | A | 8/1992 | Elrod et al. | |
| 5,813,377 | A * | 9/1998 | Matsunaga | 123/90.17 |
| 6,279,550 | B1 * | 8/2001 | Bryant | 123/559.1 |
| 6,427,653 | B1 | 8/2002 | Hara et al. | |

FOREIGN PATENT DOCUMENTS

| | | |
|---|---|---|
| DE | 3737824 | 5/1989 |
| DE | 4222477 | 2/1993 |
| DE | 4141482 | 6/1993 |
| DE | 19908435 | 9/2000 |
| DE | 10053776 | 7/2001 |
| DE | 10030904 | 1/2002 |
| DE | 10101011 | 7/2002 |
| DE | 10217695 | 11/2003 |
| JP | 1117840 | 4/1999 |
| WO | 9523912 | 9/1995 |

* cited by examiner

*Primary Examiner*—Ching Chang
(74) *Attorney, Agent, or Firm*—Dykema Gossett PLLC

(57) ABSTRACT

The invention relates to an internal combustion engine comprising a variable valve drive device provided with at least one camshaft having at least one cam arrangement. Said cam arrangement comprises a cam which can be displaced essentially radially in relation to the camshaft, and at least one, preferably two, base circle disks fixed to the camshaft.

14 Claims, 3 Drawing Sheets

INTERNAL COMBUSTION ENGINE

The invention relates to an internal combustion engine comprising a variable valve drive device having at least one camshaft with at least one cam arrangement, in which the cam can be moved essentially radially relative to the camshaft, and which has at least one, preferentially two, base circle disk(s), which are fixed on the camshaft.

From DE 100 53 776 A1 there is known a system for actuating and controlling a cam in an internal combustion engine. The cam can be moved in the radial direction of the camshaft and comprises a lifting section which moves forward and backward in the direction of the valve to be actuated, and a device which causes the cam to mesh with the camshaft or to be released from the camshaft, which actions occur in correspondence with the operational states of the engine. The cam is moved hydraulically.

From DE 42 22 477 A1 a cam valve drive for a lifting valve is known, which comprises a cam with a rigid part, which can be shifted in radial direction between a retracted and an extended position and which is guided on the corresponding camshaft and is provided with stops limiting its movement. The movement of the cam is effected by a pressure medium fed through a longitudinal bore in the camshaft.

Hydraulically actuated variable valve drives have the disadvantage that they require complex control systems and that for the active actuation of the cam the hydraulic actuating medium must be provided at relatively high pressure. Furthermore variable valve drives are usually suited for a certain type of actuation only, i.e. either hydraulical or mechanical or electrical actuation.

From publications DE 41 41 482 A1, DE 37 37 824 A1 and DE 199 08 435 A1 it is known to use pulsed charging at start-up or to facilitate start-up by delaying inlet valve opening during the starting phase.

Publication DE 102 17 695 A1 furthermore describes a start-up procedure using changed timings of the inlet valves in order to reduce compression work during start-up. JP 1-1117840 A also discloses the changing of inlet valve timings during the starting phase.

It is the object of the present invention to avoid the above mentioned disadvantages and to propose a simple variable valve drive which can be externally adjusted by diverse adjusting means, and which can be used in particular to facilitate start-up of an internal combustion engine.

The invention achieves its aim by proposing that the cam be actuated by an adjusting element positioned at the side of the camshaft. The radially movable cam is thus directly actuated by the adjusting element which is external to the camshaft. This offers the advantage that mechanical or electrical or electromagnetic adjusting means may be employed just as well as hydraulic or pneumatic adjusting means. The variable valve drive thus will not be restricted to a certain type of adjusting element only.

The radially moveable cam may be brought into the lifting position by the adjusting element prior to or during the lifting phase. Preferably, the adjusting element is configured as an actuating roller, which may for instance be adjusted by means of an eccentric mechanism.

The radially movable cam may be held on the camshaft by a spring element and is shifted back by this elastic element into its initial position inside the base circle after the lifting phase.

In order to achieve non-jamming shifting of the cam it will be advantageous if the cam has sliding surfaces which are guided on circular guiding surfaces of the camshaft. Radius and angular position of the sliding surfaces are configured such that no self-locking will occur when the cam starts to shift.

In a preferred variant of the invention it is provided that the cam is configured in two parts, the first part, which is acted on by the adjusting element, being essentially fork-shaped as seen in a side view, and holding a second part which represents the cam lobe, both parts being preferably held together by pins. The first part, which is acted on by the adjusting element, encloses the second part, which forms the cam lobe, in the shape of an U and is connected to the second part by two pins after the two parts have been slipped onto the camshaft, the first and second part together forming the whole cam.

The adjusting element has at least one working surface, which interacts with the corresponding mating surface of the first part of the cam.

It is of great advantage if the adjusting element has an essentially U-shaped cross-section with the two legs of the U forming the working surfaces, the distance of the legs being larger than the width of the second part of the cam. The adjusting element acts only on the first part of the movable cam and has a U-shaped cross-section, into which the cam lobe of the second part can retract, in such a way that no valve lift occurs in the working stroke phase of the internal combustion engine.

In order to permit easy assembly of the individual parts of the cam on the camshaft, it will be particularly advantageous if at least one of the base circle disks is provided with a radial groove into which a pin can be inserted, the grooves in one base circle disk preferably being displaced relative to the grooves in the other base circle disk. Due to the alternating position of the grooves in the two base circle disks the valve actuating element will be in uninterrupted contact with the base circle disks and discontinuities will thus be avoided.

It is furthermore proposed by the invention that at least one of the base circle disks be provided with a ramp-shaped elevation on its periphery, which together with the cam lobe of the second part of the cam forms the complete cam. The ramp-shaped elevations on the base circle disks in combination with the cam lobe of the movable cam will represent the total form of the cam. The ramp-shaped elevations on the base circle disks can also produce a defined basic opening of the gas exchange valve.

It is further proposed by the invention that the mating surface of the first part deviates from a strictly cylindrical shape and thus defines a control surface, such that the valve lift curve of the actuated lifting valve results from the shape of the mating surface of the first part and the shape of the cam lobe of the second part of the cam, where preferably the mating surface and the cam lobe of the cam are shaped in such a way that the valve lift curve is continuous especially in the region of transition between the base circle of the base circle disks and the cam lobe of the cam.

Full variability of the valve drive may particularly be used to facilitate start-up of a diesel internal combustion engine. In order to increase the temperature at the end of compression it may be provided that during the start-up phase and/or during operating phases with low compression ratio the inlet valve opening time is shifted to "late" and/or the inlet valve closing time is shifted to "early". In this way adequate conditions for ignition can be achieved at lowered compression ratios. The temperature at the end of compression can be substantially increased if multiple compression with back-flow of the cylinder charge into the intake pipe occurs. The shift in time of inlet opening or inlet closing may in this case amount to 120° crank angle or more. Measurements have shown that a significant increase of charge temperature, for instance 70° to 120° depending on engine speed, can be achieved in the vicinity of upper dead centre of compression.

With reference to the enclosed drawings the invention will now be described in more detail.

Figure 1:
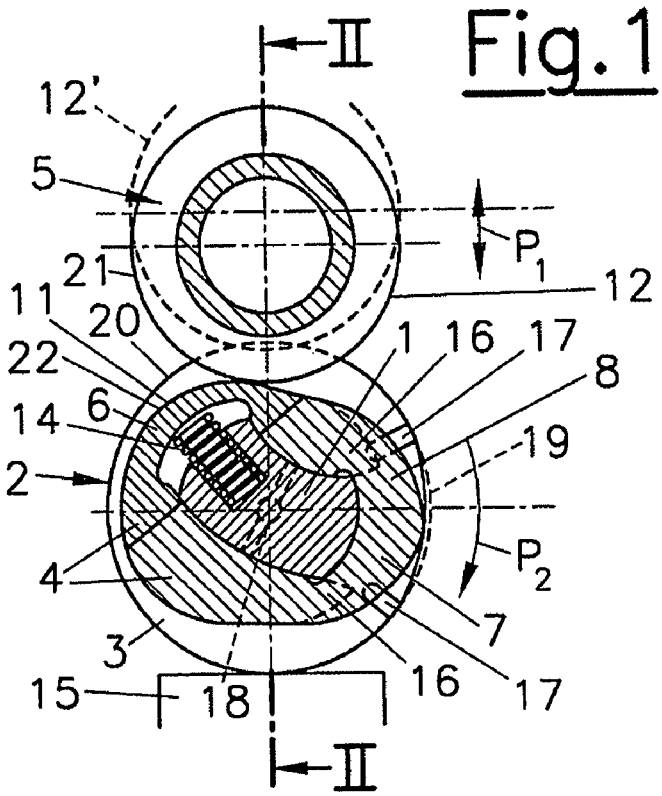
FIG. 1 shows the valve drive according to the invention at the beginning of adjustment in a section along line I-I of FIG. 2.

In each of the drawings a camshaft 1 of an internal combustion engine with variable valve drive 2 is shown. The valve drive 2 has two base circle disks 3 fixed on the camshaft 1, a cam 4, which can be essentially radially shifted on the camshaft 1, and an adjusting element 5 acting directly on the cam 4.

Figure 2:
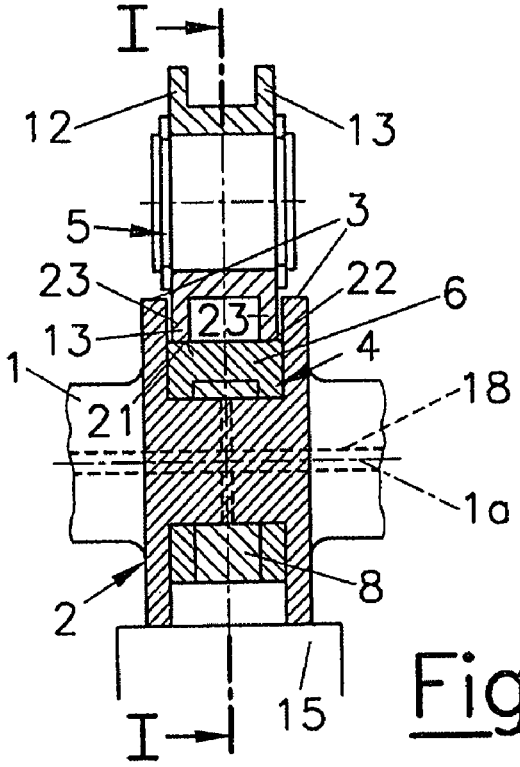
FIG. 2 shows the valve drive of FIG. 1 in a section along line II-II of FIG. 1.

The cam 4 has two interlocking parts, a first part 6 acted on by the adjusting element 5 and a second part 8 forming the cam lobe 7. First and second part 6, 8 surround guiding surfaces 9 of the camshaft 1, with the cam 4 having sliding surfaces 10 in the area of the guiding surfaces 9. The first part 6 has a fork-shaped cross-section gripping the second part 8, as can be seen from FIG. 2. Diametrically opposite the cam lobe 7 the first part 6 has a control surface 11 acted on by the adjusting element 5. In the embodiment shown the adjusting element 5 comprises an actuating roller 12 with essentially U-shaped cross-section with two legs 23, which are formed by the rims 13 of the actuating roller 12. The rims 13 act via working surfaces 21 on mating surfaces 22 formed by the control surfaces 11 of the first part 6 of the cam 4. The distance a of the rims 13 is at least the width b of the second part 8; thus no valve lift will occur during the working stroke phase of the internal combustion engine.

Figure 5:
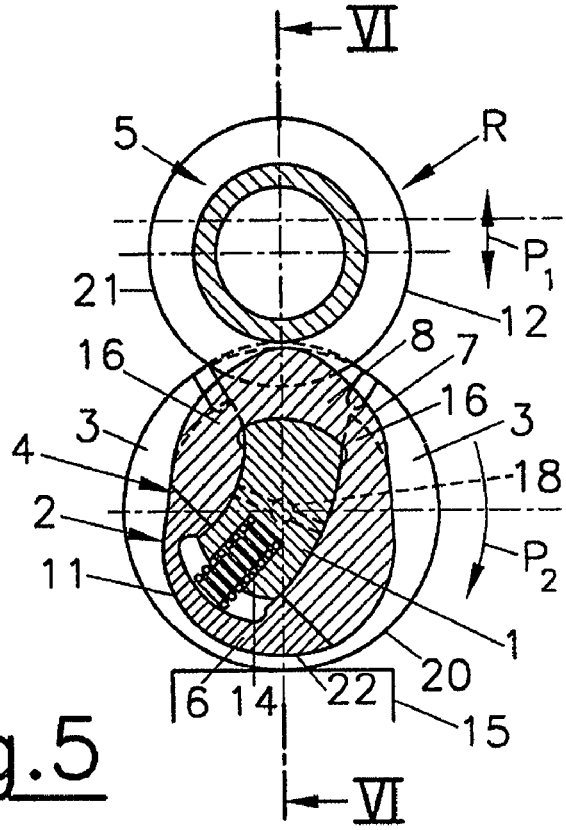
FIG. 5 shows the valve drive in the inactive position in a section along line V-V of FIG. 6.
Figure 6:
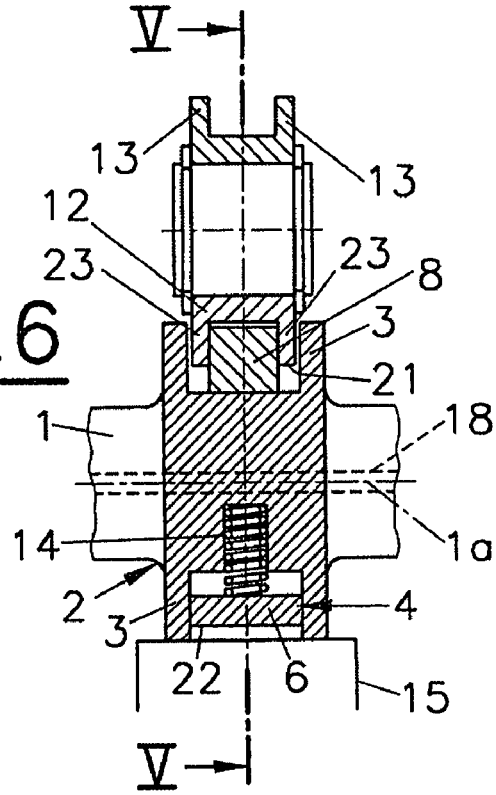
FIG. 6 shows the valve drive in a section along line VI-VI of FIG. 5.

The cam 4 is spring-loaded by an elastic element 14, the elastic element 14 pushing the cam 4 into the inactive position shown in FIGS. 5 and 6, in which only the base circle disks 3 act on the valve actuating element 15.

The first part 6 and the second part 8 of the cam 4 rest against each other and are held together by pins 16. By the elastic element 14 the cam 4 is pushed into a zero-lift position, if no force is exerted by the actuating roller 12. In the base circle disks 3 assembly grooves 17 are provided for the pins 16. The assembly grooves 17 are located in the base circle disks in an alternating manner, thus ensuring uninterrupted contact between the base circle disks 3 and the valve actuating element 15.

The actuating roller 12 is configured in such a way that the cam lobe 7 retracts into the space 18 between the rims 13 during the working stroke of the internal combustion engine. Except during the valve lift and control phase no contact is established between the actuating roller 12 and the cam 4, and the valve actuating element 15, which may be a tappet, a rocker lever or cam follower, is in contact with the base circle disks 3, which are rigidly mounted on the camshaft 4 externally to the actuating roller 12.

The guiding surfaces 9 and the sliding surfaces 10 are arc-shaped. Their angle positions and radii are chosen such that the shifting of the cam occurs without much friction and that self-locking, especially at the beginning of the movement of cam 4, is reliably avoided. Pressurized oil for lubricating the sliding surfaces 10 can be supplied without difficulty via a central bore 18 in the camshaft 1.

The base circle disks 3 can be furnished with a ramp-shaped elevation 19 on their circumference, which together with the cam lobe 7 of the movable cam 4 forms the complete cam. The ramp-shaped elevation 19 defines a minimum lift of the gas exchange valve (not shown in the drawing) and permits a uniform transition from the base circle 20 of the base circle disk 3 to the cam lobe 7 and vice versa. The shape of the valve lift curve is defined by the joint action of the control surface 11 and the cam lobe 7 of the cam 4 during the valve lift phase. By a suitable design of the control surface 11 and the cam lobe 7 a uniform transition between base circle 20 and cam lobe 7 and vice versa will be achieved.

Figure 3:
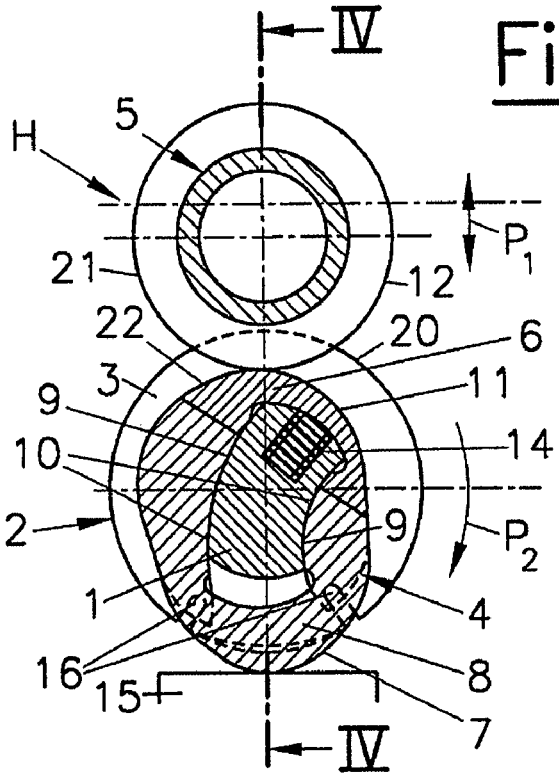
FIG. 3 shows the valve drive in lifting position in a section along line III-III of FIG. 4.
Figure 4:
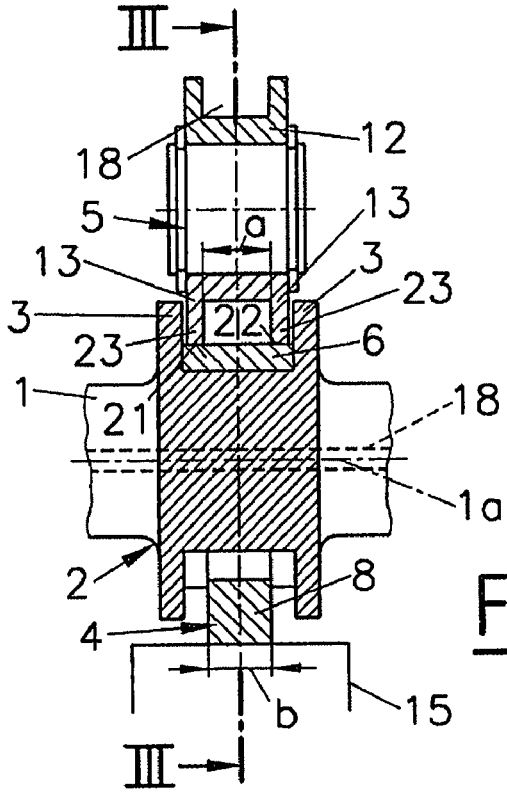
FIG. 4 shows the valve drive in a section along line IV-IV of FIG. 3.

FIG. 1 shows the valve drive 2 at the beginning of the cam adjustment. The actuating roller 12 is shifted from the inactive position indicated by dashed lines and the reference number 12', towards the camshaft 1 as shown by the arrow $P_1$, causing the rims 13 of the actuating roller 12 to act on the control surface 11 of the first part 6 of the cam 4 and thus pushing the cam 4 against the spring force of the elastic element 14 from the inactive position into the lifting position shown in FIGS. 3 and 4. In the lifting position the cam lobe 7 extends beyond the base circle disks 3 and thus acts on the valve actuating element 15. The camshaft 1 rotates in the direction indicated by arrow $P_2$.

Assembly of the first part 6 and the second part 8 on the camshaft 1 is performed by slipping the parts from opposite sides onto the guiding surfaces 9. When the cam 4 is pushed against the force of the elastic element 14 into the lifting position shown in FIG. 3, the pins 16 may be inserted through the radial grooves directed towards the axis 1*a* of the camshaft 1.

The advantage of the variable valve drive 2 lies in the fact that due to the external actuation of the adjusting element 5 a large number of variants will be possible. The adjusting element 5 may be actuated pneumatically, hydraulically, electrically, electro-magnetically, mechanically or by a combination of the methods mentioned.

The patent claims submitted with the application are suggestions concerning the draft, which are not prejudicial to further efforts for extended patent protection. The applicant reserves the right to claim further features, hitherto disclosed only in the description and/or the drawings.

References occurring in subclaims refer to further developments of the object of the main claim through features of the respective subclaim; they are not to be taken as waiving the claim of independent, object-related patent protection for the features of the referenced subclaims.

The objects of these subclaims constitute independent inventions, however, whose configuration and design are independent of the objects of preceding subclaims.

It is also understood that the invention is not restricted to the embodiment(s) of the description, but that many changes and modifications will be possible within the framework of the invention, in particular such variants, elements, combinations and/or materials, which are part of the invention for instance by combination or modification of features or elements or process steps which are described in the general description of embodiments or in the claims or contained in the drawings, and which lead by combination of features to a new object or new process steps or sequences of process steps, including manufacturing, testing and working processes.

The invention claimed is:

1. An internal combustion engine comprising a variable valve drive device provided with at least one camshaft with at least one cam arrangement, which comprises a cam which is movable essentially radially relative to the camshaft, and at least one base circle disk fixed on the camshaft, wherein the cam is actuated by an adjusting element located at a side of the camshaft, and wherein the cam comprises two parts, a first part, which is actuated by the adjusting element, being essentially fork-shaped as seen from a side and gripping a second part forming a cam lobe.

2. The internal combustion engine according to claim 1, wherein the cam is brought from an inactive position to a lifting position by the adjusting element prior to or during a lifting phase.

3. The internal combustion engine according to claim 1, wherein the cam which is movable on the camshaft in essentially radial direction is held against the camshaft in an opposite direction of the lifting position by a spring element and can be retracted to its inactive position after the lifting phase by the spring element.

4. The internal combustion engine according to claim 3, wherein the cam in its inactive position is within the base circle of the base circle disk.

5. The internal combustion engine according to claim 1, wherein the cam is borne by sliding surfaces on circular guiding surfaces of the camshaft.

6. The internal combustion engine according to claim 1, wherein first and second part are held together by pins.

7. The internal combustion engine according to claim 1, wherein at least one base circle disk has a radial groove into which a pin can be inserted.

8. The internal combustion engine according to claim 7, wherein the grooves of one base circle are displaced relative to those of another base circle disk.

9. The internal combustion engine according to claim 1, wherein at least one base circle disk has a ramp-shaped elevation, which together with the cam lobe of the second part of the cam defines the lift curve of at least one gas exchange valve.

10. The internal combustion engine according to claim 1, wherein the adjusting element has at least one working surface, which interacts with a corresponding mating surface on the first part of the cam.

11. The internal combustion engine according to claim 10, wherein the adjusting element has an essentially U-shaped cross-section with two legs of the U as working surfaces, the legs having a distance from each other which is greater than a width of the second part of the cam.

12. The internal combustion engine according to claim 10, wherein the adjusting element is configured as an actuating roller, which actuating roller has a flange-like rim serving as the working surface.

13. The internal combustion engine according to claim 10, wherein the mating surface of the first part of the cam deviates from a strictly cylindrical shape and defines a control surface, such that the valve lift curve of the corresponding gas exchange valve is generated by the shape of the control surface of the first part and the shape of the cam lobe of the second part of the cam.

14. The internal combustion engine according to claim 13, wherein the control surface and the cam lobe of the cam are shaped in such a way that the valve lift curve is continuous, especially in a region of transition between the base circle of the base circle disks and the cam lobe of the cam.

* * * * *